US010054407B2

(12) United States Patent
Moore et al.

(10) Patent No.: US 10,054,407 B2
(45) Date of Patent: Aug. 21, 2018

(54) BROADHEAD FOR BOW HUNTING ARROW

(71) Applicants: Sam Tomlin Moore, Sedan, KS (US); James Loftin Meadows, Jr., Mooresville, NC (US)

(72) Inventors: Sam Tomlin Moore, Sedan, KS (US); James Loftin Meadows, Jr., Mooresville, NC (US)

( * ) Notice: Subject to any disclaimer, the term of this patent is extended or adjusted under 35 U.S.C. 154(b) by 0 days.

(21) Appl. No.: 14/572,476

(22) Filed: Dec. 16, 2014

(65) Prior Publication Data

US 2015/0168111 A1 Jun. 18, 2015

Related U.S. Application Data

(60) Provisional application No. 61/916,753, filed on Dec. 16, 2013.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 2,005,424 | A * | 6/1935 | Kindle | F42B 6/08 473/583 |
| 5,931,751 | A * | 8/1999 | Cooper | 473/583 |
| 6,663,518 | B1 * | 12/2003 | Kuhn | 473/583 |
| 6,966,856 | B1 * | 11/2005 | Hajek | 473/583 |
| 7,037,223 | B2 * | 5/2006 | Kuhn | 473/583 |
| 7,160,217 | B2 * | 1/2007 | Sohm | F42B 6/08 473/583 |
| 7,942,765 | B2 * | 5/2011 | Odabachian et al. | 473/583 |
| 8,100,788 | B2 * | 1/2012 | Sanford | 473/584 |
| 8,313,398 | B2 | 11/2012 | Baker | |

* cited by examiner

*Primary Examiner* — John Ricci
(74) *Attorney, Agent, or Firm* — Richard E. Oney; Venjuris, P.C.

(57) ABSTRACT

An improved broadhead for an archery arrow includes a blade member having a rear portion, a tip opposite the rear portion with a chisel point, and a pair of opposing blades. The tip can be generally flat. Each of the opposing blades includes a cutting edge disposed between the blade member rear portion. Each cutting edge includes a concave curved portion, and can include a beveled portion. Each of the opposing blades has a surface that includes a radial curve and each of the cutting edges has a generally helical shape. The blade member can be formed from a single sheet of metal. The blade member can be fixed to a ferrule for mounting to an arrow.

17 Claims, 5 Drawing Sheets

BROADHEAD FOR BOW HUNTING ARROW

RELATED APPLICATION

This application claims the benefit of U.S. Provisional Application No. 61/916,753, filed Dec. 16, 2013, entitled "Broadhead for Bow Hunting Arrow," which is incorporated herein in its entirety by this reference.

BACKGROUND

The present invention relates generally to archery arrowheads. More particularly, the present invention relates to an improved design of a broadhead-type arrowhead.

Many of the game hunters practicing bow and arrow hunting have found the use of a broadhead-type arrow achieves more efficient results, particularly in the hunting of relatively large game. For such game hunting, it is preferable that the arrow strike and kill the target as quickly and humanely as possible. Previously available broadhead-type arrowheads—known also as "broadheads"—have certain disadvantages in that the speed, distance, and the accuracy of flight of the arrow shaft through the air is frequently adversely affected by the structural configuration of the broadhead.

Accordingly, a feature and advantage of the present invention is its ability to overcome the deficiencies in prior art broadhead arrowheads by providing an improved broadhead.

Additional objectives and advantages of the invention will be set forth in the description that follows, and in part will be apparent from the description, or may be learned by practice of the invention. The objects and advantages of the invention may be realized and obtained by means of the instrumentalities and combinations pointed out in this specification, including the amended claims.

SUMMARY

To achieve the foregoing objectives, and in accordance with the purposes of the invention as embodied and broadly described in this document, there is provided an improved broadhead for an archery arrow. The broadhead includes a blade member having a rear portion, a tip opposite the rear portion, and a pair of opposing blades. The tip can be generally flat and is tapered to a chisel point. Each of the opposing blades includes a cutting edge disposed between the blade member rear portion of the tip. The cutting edge of each of the opposing blades includes a concave curved portion, and can include a beveled portion. In one advantageous embodiment, each of the opposing blades has a surface that includes a radial curve and each of the cutting edges has a generally helical shape. The blade member can be formed from a single sheet of metal and can be fixed to a ferrule for mounting to an arrow shaft.

In one embodiment, the broadhead also includes a second smaller blade member having a rear portion, a forward portion, and a pair of opposing blades. The first and second blade members are positioned in a generally orthogonal relationship. Each of the opposing blades of the second blade member includes a cutting edge disposed between the second blade member rear portion and the forward portion. Each cutting edge of the opposing blades of the second blade member includes a concave curved portion. Each of the opposing blades of second blade member can have a surface that includes a radial curvature and each cutting edge of the blades of the second blade member can include a beveled portion.

BRIEF DESCRIPTION OF THE DRAWINGS

The accompanying drawings, which are incorporated in and constitute a part of the specification, illustrate the presently preferred embodiments and methods of the invention and, together with the general description given above and the detailed description of the preferred embodiments and methods given below, serve to explain the principles of the invention.

DESCRIPTION

Reference in this application is made to presently preferred embodiments of the invention. While the invention is described more fully with reference to these examples, the invention in its broader aspects is not limited to the specific details, representative devices, and illustrative examples shown and described. Rather, the description is to be understood as a broad, teaching disclosure directed to persons of ordinary skill in the appropriate arts, and not as limiting upon the invention.

It will be appreciated that terms such as "forward," "inner," "outer," "vertical," "horizontal," "bottom," "below," "top," "side," "inwardly," "outwardly," "downwardly" and "rearward" and other positionally descriptive terms used in this specification are used merely for ease of description and refer to the orientation of the referenced components as shown in the Figures. It should be understood that any orientation of the components described herein is within the scope of the present invention. The term "generally" as used in this specification is defined as "being in general but not necessarily exactly or wholly that which is specified." For example, "generally orthogonal" is used herein to indicate components that are in general, but not necessarily exactly or wholly, orthogonal.

Figure 4:
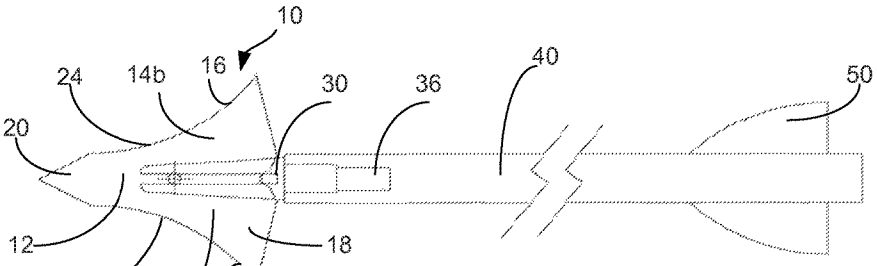
FIG. 4 is a side view showing the broadhead of FIGS. 1 and 2 affixed to an arrow shaft using the ferrule of FIG. 3.
Figure 3:
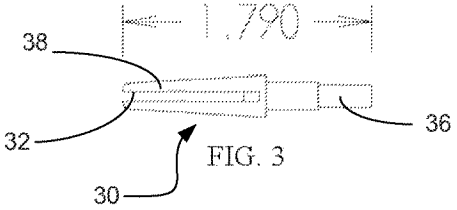
FIG. 3 is a side view of a ferrule for affixing the broadhead of FIGS. 1 and 2 to an arrow shaft.
Figure 1:
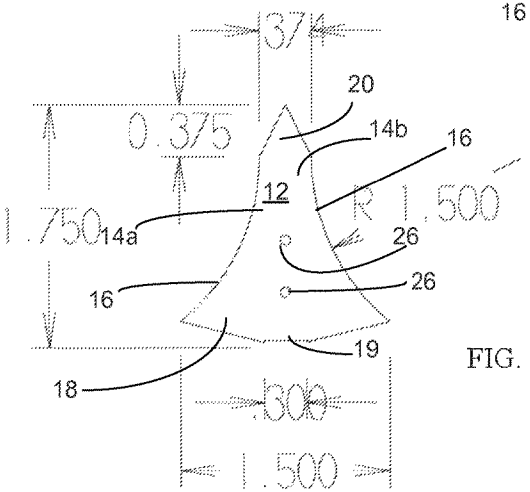
FIG. 1 is a side elevation view of one embodiment of a broadhead according to the present invention, which embodiment has two blades.
Figure 2:
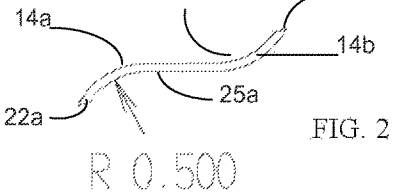
FIG. 2 is a rear end view of the broadhead of FIG. 1 showing the curvature of the winglet design of the blades and the profile of the tip.

Referring to FIGS. 1-4, one embodiment of a broadhead 10 according to the present invention includes a blade member 12 having a rear portion 18, a tip 20, and two opposing blade portions 14. Each of the blades 14 has a cutting edge 16 extending from the blade member rear portion 18 to the tip 20. Each cutting edge 16 is razor sharp and has a bevel 22 along its length, with the bevel 22*a* of one blade 14*a* being formed on an opposing side to that of the bevel 22*b* on the opposing blade 14*b*. As shown in FIGS. 2 and 4, each cutting edge 16 has a side profile that includes a concave portion 24 between the tip 20 and the rear portion 18, and the tip 20 has a tapered, chisel shape. As shown in FIG. 2, the surface of each of the blades 14*a*, 14*b* has a radial curvature 25*a*, 25*b* that curves in an opposing direction to the curvature of the other blade. In this configuration, the blade member 12 forms a winglet.

Still referring to FIGS. 1-4, the blade member 12 includes one or more through holes 26 for mounting the blade member 12 to a tapered ferrule 30. The ferrule 30 has a longitudinal slot 32 that is open at the ferrule forward end 38 for receiving the blade member 12. The ferrule rear end 36 is threaded for mounting the ferrule 30 to a mating threaded hole in an end of an arrow shaft 40 opposite the fletching 50. The ferrule 30 includes at least one transverse mounting hole 34 for receiving a mounting connector 28 (seen FIGS. 5-7) such as a rivet, screw or the like. The blade member rear portion 18 is provided with a notch 19 for providing a more stable engagement with the ferrule 30.

Advantageously, the blade member 12 can be fabricated from a single sheet of metal. In one embodiment, the blade member can have the approximate dimensions shown (in inches) in FIGS. 1-4.

Figure 5:
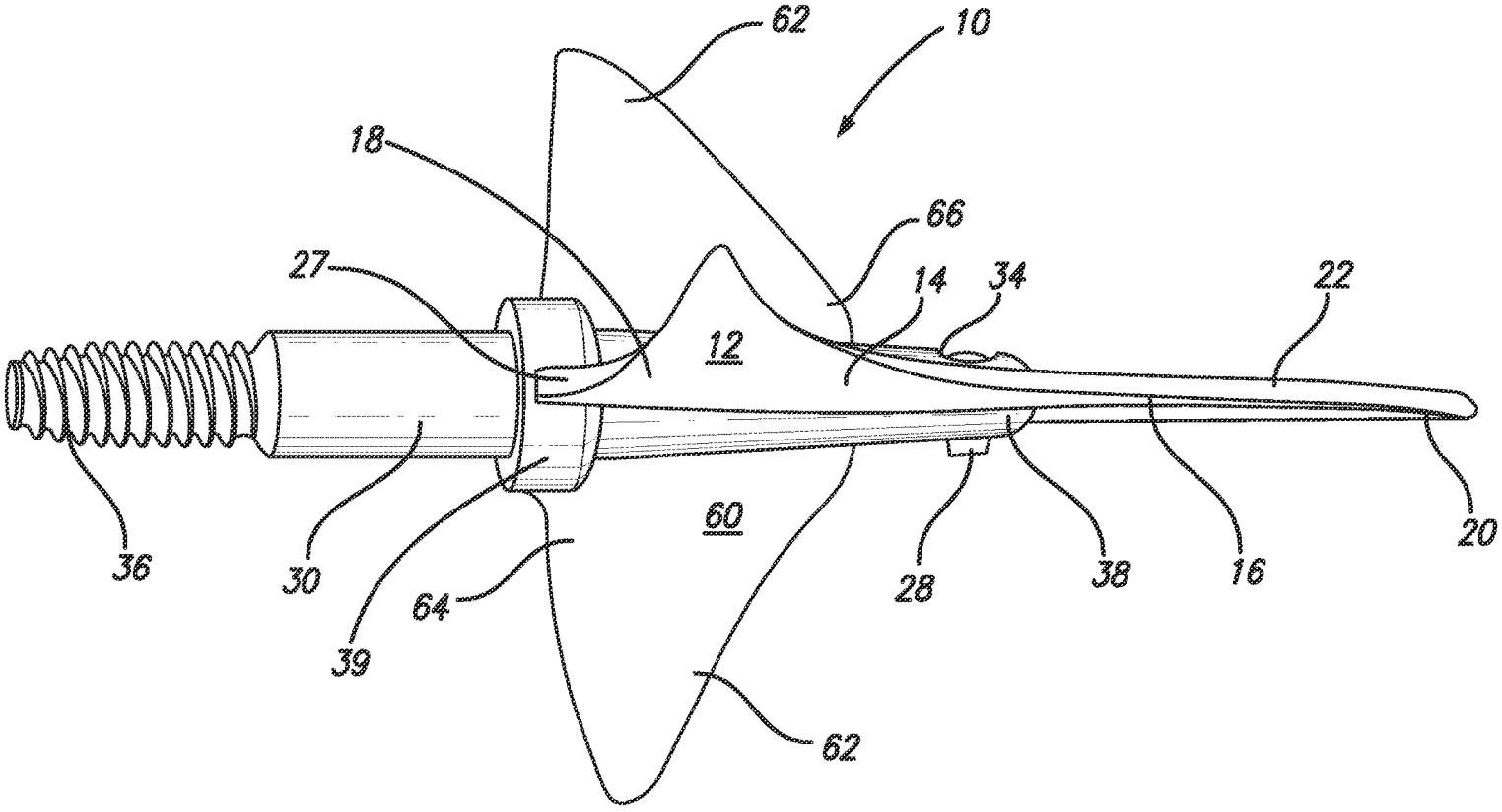
FIG. 5 is a side perspective view of another embodiment of a broadhead according to the present invention, which embodiment has two blade members and four blades.
Figure 6:
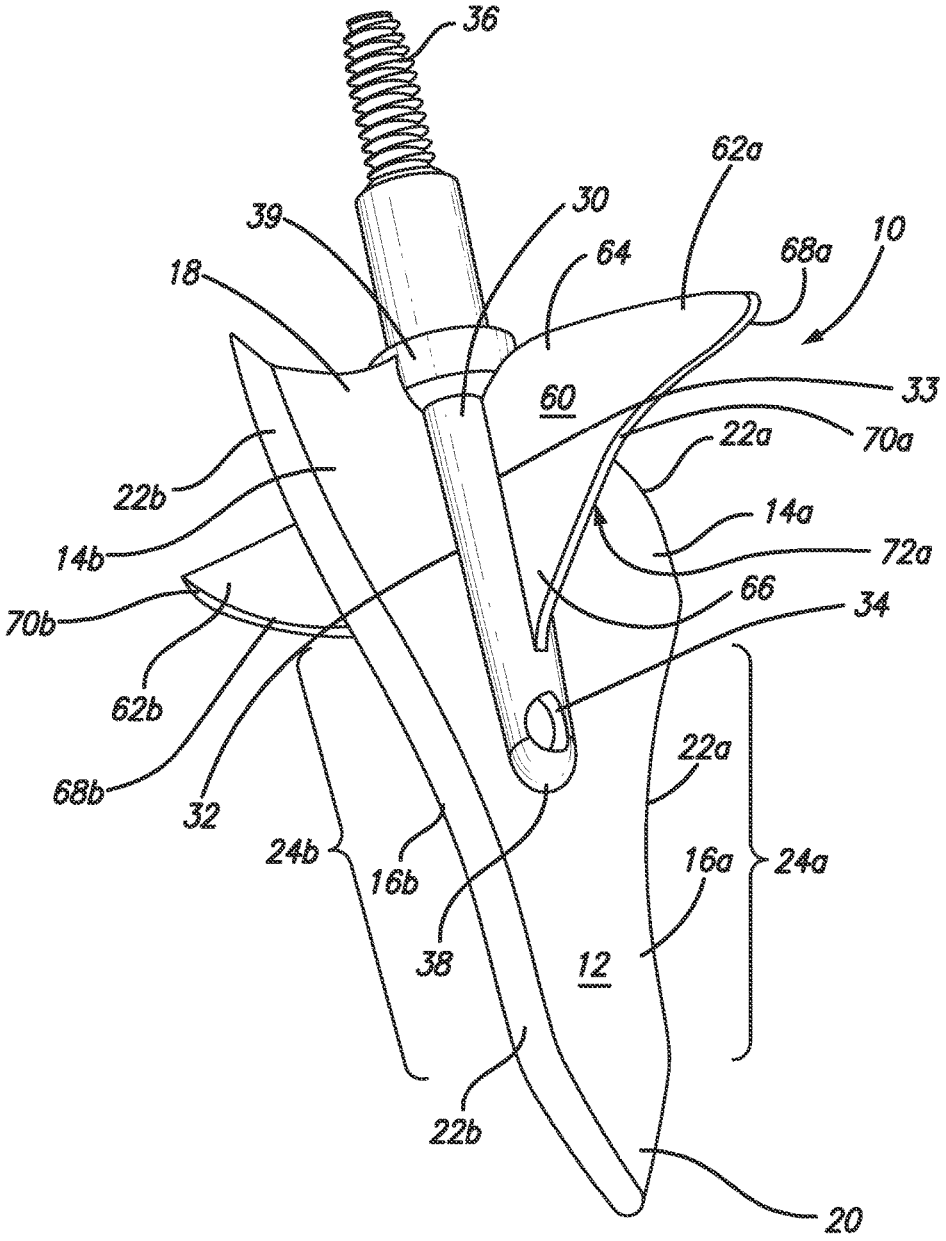
FIG. 6 is another side perspective view of the broadhead of FIG. 5.
Figure 7:
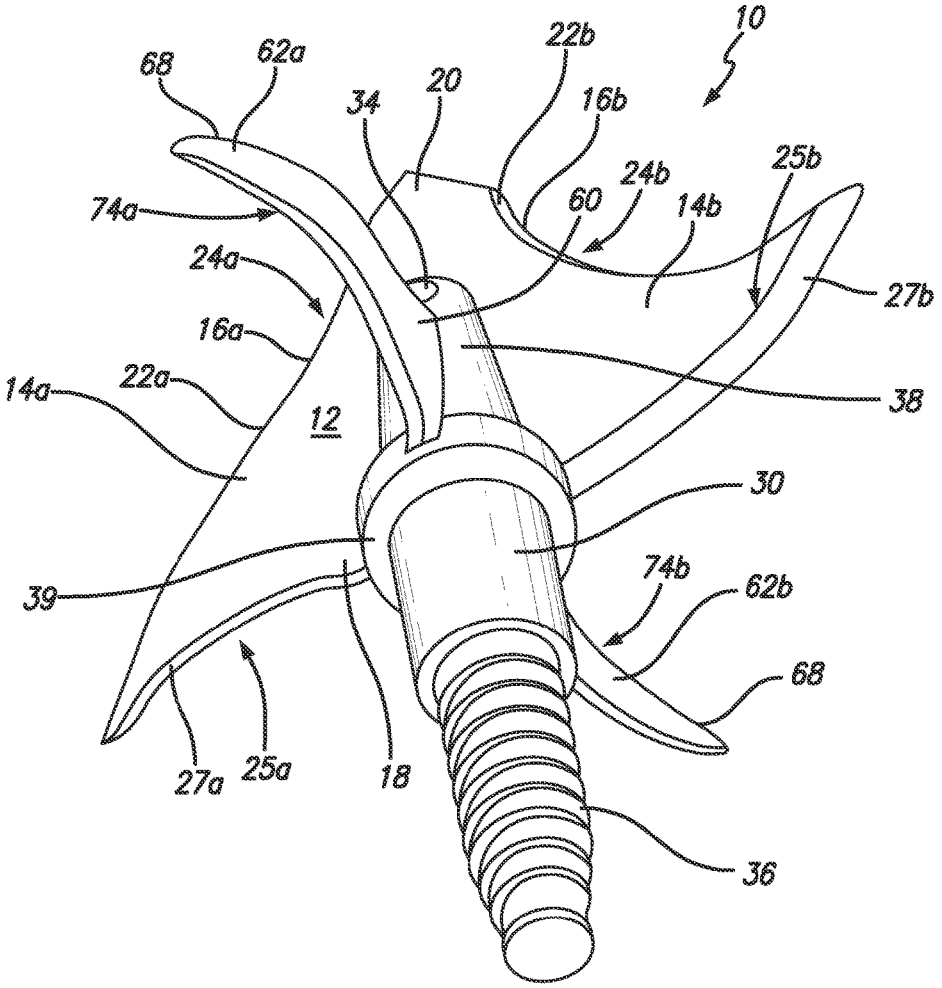
FIG. 7 is a rear perspective view of the broadhead of FIG. 5

Referring to FIGS. 5-7, another embodiment of a broadhead 10 according to the present invention has four blades. The broadhead 10 includes a blade member 12 similar to that described above and having the rear portion 18, the tip 20, and the two opposing blades 14. Each of the blades 14 includes the cutting edge 16 extending from the blade member rear portion 18 to the tip 20. Each cutting edge 16 includes the bevel 22 along its length. Each blade 14 also includes a rear beveled edge 27. The blade member 12 is affixed to a ferrule 30 as described above. In this embodiment, the ferrule 30 has a retention collar 39 disposed between its forward end 38 and rear end 36.

Still referring to FIGS. 5-7, each cutting edge 16 has a side profile that includes a concave portion 24 between the tip 20 and the blade member rear portion 18, and the tip 20 has a chisel shape. The surface of each of the blades 14*a*, 14*b* has a gradual curvature 25*a*, 25*b* that is continuous from the rear portion 18 to the base of the tip 20 and is in an opposing direction to the curvature of the opposing blade. In this configuration, the blade member 12 forms a winglet and the cutting edge 16 has a helical shape.

Figure 9:
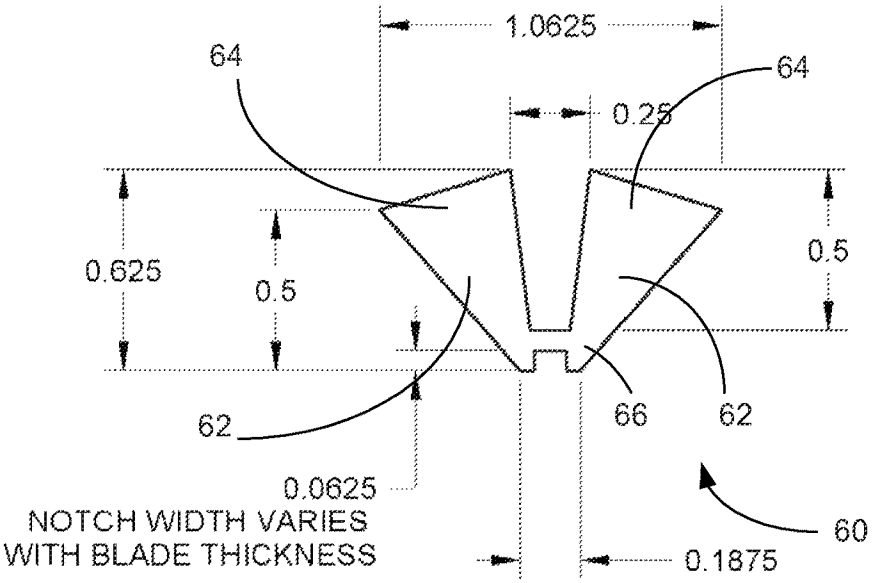
FIG. 9 is a side elevation view of the smaller blade member of the broadhead of FIG. 5.
Figure 8:
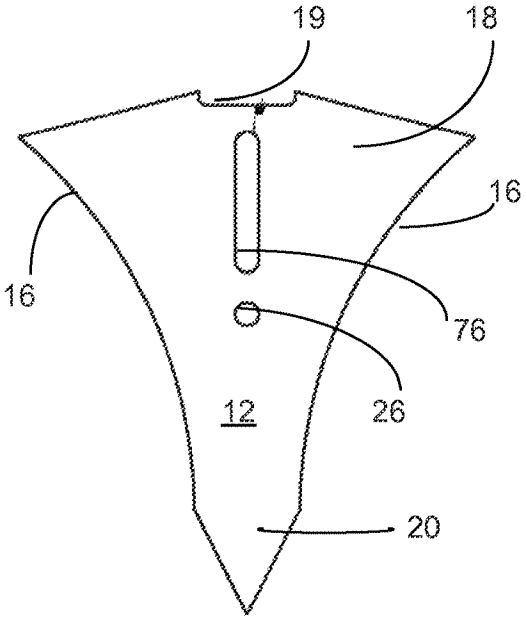
FIG. 8 is a side elevation view of the larger blade member of the broadhead of FIG. 5.

In the embodiment of FIGS. 5-7, the broadhead 10 also has a second, smaller blade member 60 (see also FIG. 9) with two opposing blade portions 62, a rear portion 64 and a forward portion 66. The smaller blade member 60 is fixed in a generally orthogonal relationship to the larger blade member 12. To accomplish this, the ferrule 30 has a second longitudinal slot 33, which is disposed orthogonally to the longitudinal slot 32 and is sized to slidingly receive the smaller blade member 60. The larger blade member 12 also includes a longitudinal slot 72 extending from the rear portion 18 to a point rearward of the mounting hole 34 (see, e.g., FIG. 8). This slot 72 allows the smaller blade member 60 to be held by the ferrule 30 in a fixed orthogonal relationship with the larger blade member 12.

Each of the blades 62 has a cutting edge 68 extending from the blade member rear portion 64 to the forward portion 66. Each cutting edge 68 has a bevel 70 along its length, with the bevel 70*a* of one blade 62*a* being formed on an opposing side to that of the bevel 70*b* on the opposing blade 62*b*. Each cutting edge 68 has a side profile that includes a concave portion 72 between the blade member rear portion 64 and the forward portion 66. The surface of each of the blades 62*a*, 62*b* has a continuous gradual curvature 74*a*, 74*b* that is in an opposing direction to the curvature of the opposing blade. In this configuration, the smaller blade member 60 forms a winglet and each cutting edge 68 has a helical shape.

The broadhead 10 of the present invention provides a number of benefits over previously known broadhead designs. It provides superior accuracy. The broadhead of the invention spins and guides the arrow from the front, while the arrow fletching 50 provides stability. The design of the broadhead 10 reduces drag on both the broadhead and arrow, allowing more range and more energy, with more force than previous broadheads of similar weight. The broadhead 10 also allows for a wider cutting surface, resulting in an expanded wound channel much larger than the broadhead's physical dimensions.

The broadhead of the present invention also provides excellent penetration. This results from the chisel shape of the tip 20, the concave opposing beveled blades 14 and the winglet design, which cause the arrow and the broadhead to rotate in flight. The broadhead provides an unparalleled wound channel for a fixed two-blade head. The opposite-side bevel and a winglet design force the broadhead 10 to rotate through the target causing a large wound channel of many angles slicing many more blood vessels on a bias (angle) allowing for more blood loss. The spinning action also creates wide entry and exit holes allowing for enhanced blood trails unlike the conventional slit that most broadheads cut. This has the benefit of a quicker, more humane kill, resulting in quicker animal recoveries.

Upon reading this disclosure, those skilled in the art will appreciate that various changes and modifications can be made to the preferred embodiments and methods of the invention without departing from the spirit of the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. A broadhead for an archery arrow, the broadhead comprising:

a blade member having a rear portion, a tip opposite the rear portion, and a pair of opposing blades;

wherein each of the opposing blades includes a cutting edge disposed between the blade member rear portion and the tip;

wherein the cutting edge of each of the opposing blades includes a concave curved portion;

wherein the blade member tip is generally flat and has a profile defined by a first tip edge and an opposing second tip edge wherein the first tip edge intersects the cutting edge of one opposing blade at an obtuse angle and the second tip edge intersects the cutting edge of the other opposing blade an obtuse angle, and wherein the first and second tip edges converge to form an acute angle at a tip point;

wherein each of the opposing blades has a surface that includes a radial curvature, and the radial curvature of one of the blades curves in an opposing direction to the radial curvature of the other blade.

2. The broadhead of claim 1, wherein each of the cutting edges has a generally helical shape.

3. The broadhead of claim 1 wherein each of the cutting edges includes a beveled portion.

4. The broadhead of claim 1, wherein the blade member is fixed to a ferrule.

5. The broadhead of claim 1, wherein the blade member is formed from a single sheet of metal.

6. The broadhead of claim 1 wherein the rear portion of the blade member includes a rear beveled edge having a beveled portion.

7. A broadhead for an archery arrow, the broadhead comprising:

a first blade member having a rear portion, a tip opposite the rear portion, and a pair of opposing blades;

wherein each of the opposing blades of the first blade member includes a cutting edge disposed between the first blade member rear portion and the tip;

wherein the cutting edge of each of the opposing blades of the first blade member includes a concave curved portion;

wherein the first blade member tip is generally flat and has a profile defined by a first tip edge and an opposing second tip edge wherein the first tip edge intersects the cutting edge of one opposing blade at an obtuse angle and the second tip edge intersects the cutting edge of the other opposing blade an obtuse angle, and wherein the first and second tip edges converge to form an acute angle at a tip point;

wherein each of the opposing blades of the first blade member has a surface that includes a radial curvature and the radial curvature of one of the blades of the first blade member curves in an opposing direction to the radial curvature of the other blade of the first blade member; and a second blade member having a rear portion, a forward portion, and a pair of opposing blades;

wherein each of the opposing blades of the second blade member includes a cutting edge disposed between the second blade member rear portion and the forward portion; and wherein each cutting edge of the opposing blades of the second blade member includes a concave curved portion.

8. The broadhead of claim 7 wherein each cutting edge of the blades of the first blade member includes a beveled portion.

9. The broadhead of claim 7, wherein each cutting edge of the blades of the first blade member has a generally helical shape.

10. The broadhead of claim 7, wherein each of the opposing blades of the second blade member has a surface that includes a radial curvature.

11. The broadhead of claim 7 wherein each cutting edge of the blades of the second blade member includes a beveled portion.

12. The broadhead of claim 7, wherein each of the cutting edges of the blades of the second blade member has a generally helical shape.

13. The broadhead of claim 7, wherein the first and second blade members are fixed to a ferrule.

14. The broadhead of claim 7, wherein the first blade member is formed from a single sheet of metal.

15. The broadhead of claim 7 wherein the first and second blade members are fixed in a generally orthogonal relationship.

16. The broadhead of claim 7 wherein the rear portion of at least one of the first blade member and the second blade member includes a rear edge having a beveled portion.

17. A broadhead for an archery arrow, the broadhead comprising:

a first blade member having a rear portion, a tip opposite the rear portion, and a pair of opposing blades;

a second blade member having a rear portion, a forward portion, and a pair of opposing blades;

wherein each of the opposing blades of the first blade member includes a cutting edge disposed between the first blade member rear portion and the tip; and wherein each of the opposing blades of the first blade member has a surface that includes a radial curvature and the radial curvature of one of the opposing blades of the first blade member curves in an opposing direction to the radial curvature of the other of the opposing blades of the first blade member;

wherein the cutting edge of each of the opposing blades of the first blade member has a generally helical shape and includes a concave curved portion and a beveled portion;

wherein each of the opposing blades of the second blade member includes a cutting edge disposed between the second blade member rear portion and the forward portion;

wherein each of the opposing blades of the second blade member has a surface that includes a radial curvature;

wherein the cutting edge of each of the opposing blades of the second blade member has a generally helical shape and includes a concave curved portion and a beveled portion;

wherein the first blade member tip is generally flat and has a profile defined by a first tip edge and an opposing second tip edge wherein the first tip edge has a generally straight profile and intersects the concave curved portion of the cutting edge of one opposing blade at an obtuse angle and the second tip edge has a generally straight profile and intersects the concave curved portion of the cutting edge of the other opposing blade an obtuse angle, and wherein the first and second tip edges converge to form an acute angle at a tip point; and wherein the rear portion of at least one of the first blade member and the second blade member includes a rear edge having a beveled portion.

* * * * *